US010034563B2

(12) United States Patent
Held

(10) Patent No.: US 10,034,563 B2
(45) Date of Patent: Jul. 31, 2018

(54) PORTABLE HEAD SUPPORT

(71) Applicant: Joan Mary Held, Oxford, FL (US)

(72) Inventor: Joan Mary Held, Oxford, FL (US)

( * ) Notice: Subject to any disclaimer, the term of this patent is extended or adjusted under 35 U.S.C. 154(b) by 133 days.

(21) Appl. No.: 15/266,542

(22) Filed: Sep. 15, 2016

(65) Prior Publication Data

US 2018/0070749 A1 Mar. 15, 2018

(51) Int. Cl.
*A47G 9/10* (2006.01)

(52) U.S. Cl.
CPC .... *A47G 9/1054* (2013.01); *A47G 2009/1018* (2013.01)

(58) Field of Classification Search
CPC ..... A47G 2009/1018; A47G 9/10; A47G 9/1054; A47G 9/1072; A47G 9/1081; A47G 9/109; A47G 9/1009; A47G 9/1063; A61G 7/07; A61G 7/1084; A61G 13/121; A61G 13/1215
See application file for complete search history.

(56) References Cited

U.S. PATENT DOCUMENTS 4,288,071 A * 9/1981 Glickson ..... A63G 31/12 472/106
4,333,638 A 6/1982 Gillotti
5,224,956 A * 7/1993 Dumas ..... A61G 7/07 606/240
5,269,035 A * 12/1993 Hartunian ..... A47C 20/026 5/637
5,287,576 A 2/1994 Fraser
5,347,668 A 9/1994 Manning
5,542,910 A * 8/1996 Oliver ..... A47G 9/1009 5/622
6,047,420 A 4/2000 Priester, III et al.
6,079,066 A * 6/2000 Backlund ..... A47G 9/10 5/636
6,721,978 B1 4/2004 Tankersley
7,080,420 B2 7/2006 Damron
8,469,032 B2 6/2013 Farnum
2008/0086819 A1* 4/2008 Valero Pavia ..... A47G 9/10 5/640

(Continued)

*Primary Examiner* — Nicholas F Polito
*Assistant Examiner* — Abigail R Hymel
(74) *Attorney, Agent, or Firm* — Peter J. Rashid

(57) ABSTRACT

A portable head support includes an upper portion having a top surface and a lower portion having a bottom surface. The top surface includes a first lobe portion at one end, a second lobe portion at an opposite end, and an intermediate or shaft portion separating the first and second lobe portions. The intermediate or shaft portion has a height, $H_I$, and a length, $L_I$, with respect to the bottom surface and the first and second lobe portions each have a height, $H_2$, and a length, $L_L$ with respect to the bottom surface. The height, $H_1$, and the length, $L_I$, of the intermediate or shaft portion are less than the height, $H_L$, and the length, $L_L$, of the first and second lobe portions. The bottom surface includes a groove for allowing the portable head support to be mounted onto an object.

11 Claims, 6 Drawing Sheets

(56) References Cited

U.S. PATENT DOCUMENTS

| | | | | |
|---|---|---|---|---|
| 2010/0037395 | A1* | 2/2010 | Heeter | A47D 13/08 5/655 |
| 2011/0277923 | A1* | 11/2011 | Fox | B29D 35/148 156/245 |
| 2014/0352069 | A1* | 12/2014 | Verde Sanchez | A61G 7/072 5/636 |
| 2015/0150391 | A1* | 6/2015 | Hsu | A47G 9/10 5/636 |
| 2015/0182044 | A1* | 7/2015 | Fan | B60N 2/882 5/644 |
| 2016/0073801 | A1* | 3/2016 | Shin | A47G 9/1045 5/636 |

* cited by examiner

PORTABLE HEAD SUPPORT

FIELD OF THE INVENTION

The invention relates, in general, to pillows or head supports and, more particularly to a portable head support on which a person can rest his or her head to sleep or to relax while in a sitting position or in a prone position.

BACKGROUND OF THE INVENTION

Some head rests are designed to be mounted on a table during a medical procedure or during a massage therapy session. In this example, the user is in a prone position. In another example, some head rests are designed with angled surfaces to be placed on a flat surface to allow a user to place their forehead and chin on the head rest while in a sitting position. However, none of the head rests are designed to be used in both a sitting and a prone position.

In addition, most head rest designs do not allow the head rest to be easily portable. Thus, there is a need to provide an improved head support design that solves the problems mentioned above.

SUMMARY OF THE INVENTION

Based on the above, the problem of providing a head support that is easily portable and can be mounted on an object such that the head support can be used in either a sitting or a prone position by the user is solved by a portable head support made of a lightweight, flexible material having a shaft portion and lobe portions on the top surface and a groove in a bottom surface.

In one aspect, a portable head support comprises an upper portion having a top surface, and a lower portion having a bottom surface. The top surface includes a first lobe portion at one end, a second lobe portion at an opposite end, and an intermediate or shaft portion separating the first and second lobe portions.

In another aspect, a portable head support comprises an upper portion having a top surface, and a lower portion having a bottom surface. The top surface includes a first lobe portion at one end, a second lobe portion at an opposite end, and an intermediate or shaft portion separating the first and second lobe portions. The intermediate or shaft portion has a height, $H_I$, and a length, $L_I$, with respect to the bottom surface and the first and second lobe portions each have a height, $H_2$, and a length, $L_L$ with respect to the bottom surface. The height, $H_1$, and the length, $L_I$, of the intermediate or shaft portion are less than the height, $H_L$, and the length, $L_L$, of the first and second lobe portions.

In yet another aspect, a portable head support comprises an upper portion having a top surface, and a lower portion having a bottom surface. The top surface includes a first lobe portion at one end, a second lobe portion at an opposite end, and an intermediate or shaft portion separating the first and second lobe portions. The intermediate or shaft portion has a height, $H_I$, and a length, $L_I$, with respect to the bottom surface and the first and second lobe portions each have a height, $H_2$, and a length, $L_L$ with respect to the bottom surface. The height, $H_1$, and the length, $L_I$, of the intermediate or shaft portion are less than the height, $H_L$, and the length, $L_L$, of the first and second lobe portions. The bottom surface includes a groove for allowing the portable head support to be mounted onto an object. The groove has a cross-sectional shape that substantially conforms to a cross-sectional shape of the object to allow the portable head support to be removably mounted thereon.

BRIEF DESCRIPTION OF THE DRAWINGS

Exemplary embodiments of the invention are described in detail by the use of figures. In the figures, identically acting parts are given the same reference numbers.

DETAILED DESCRIPTION OF THE INVENTION

Figure 1:
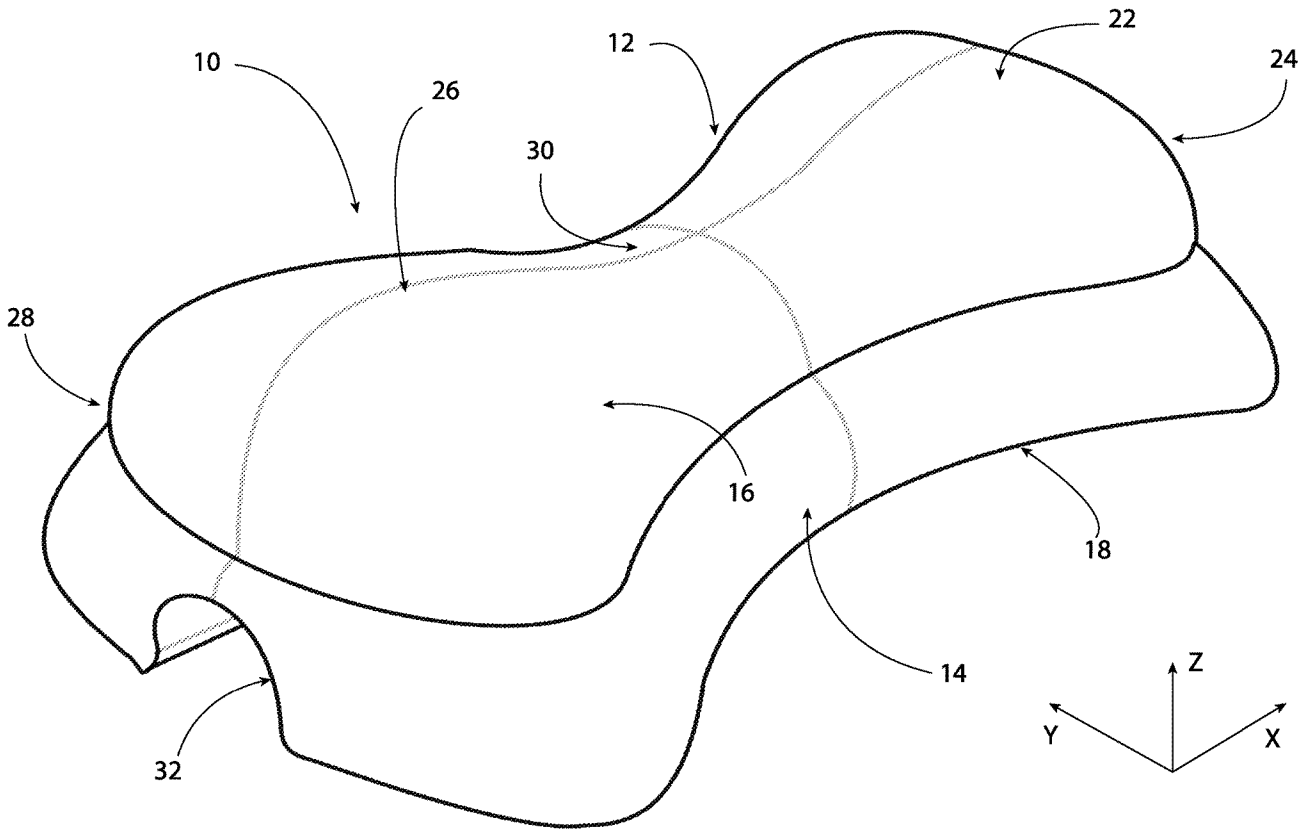
FIG. 1 is an isometric view of a portable head support according to an embodiment of the invention.
Figure 2:
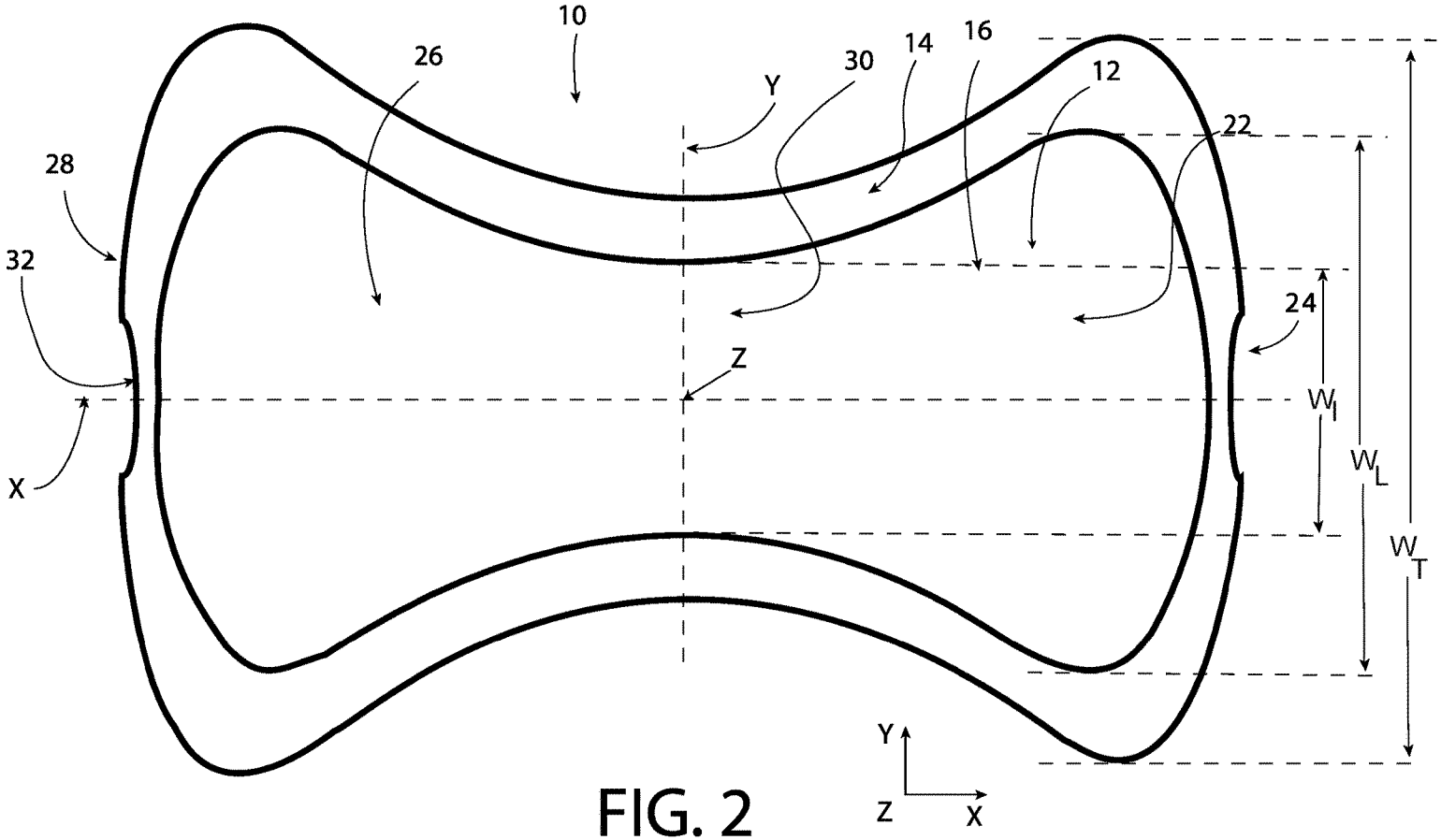
FIG. 2 is a top view of the portable head support of FIG. 1.
Figure 3:
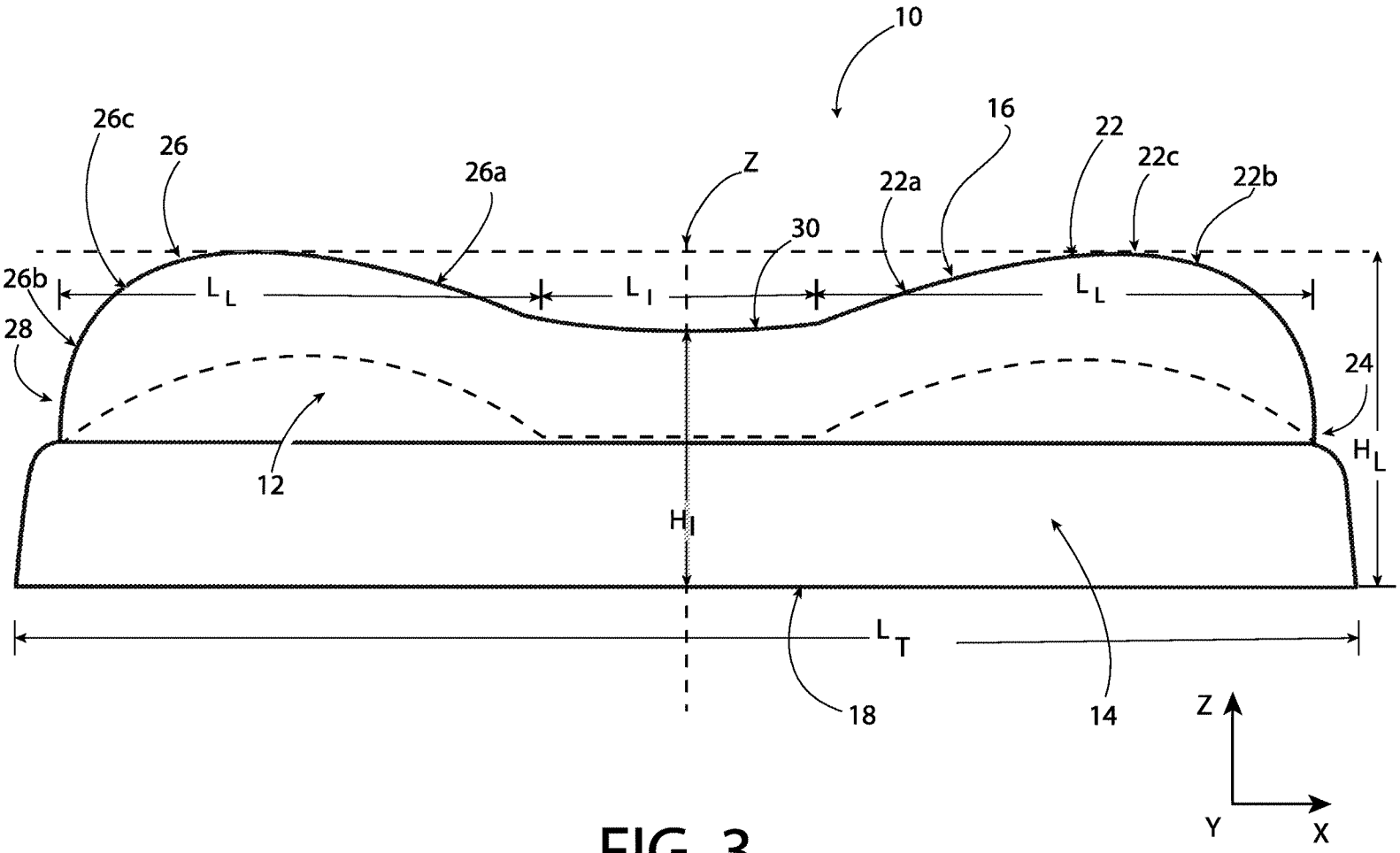
FIG. 3 is a front view of the portable head support of FIG. 1.
Figure 4:
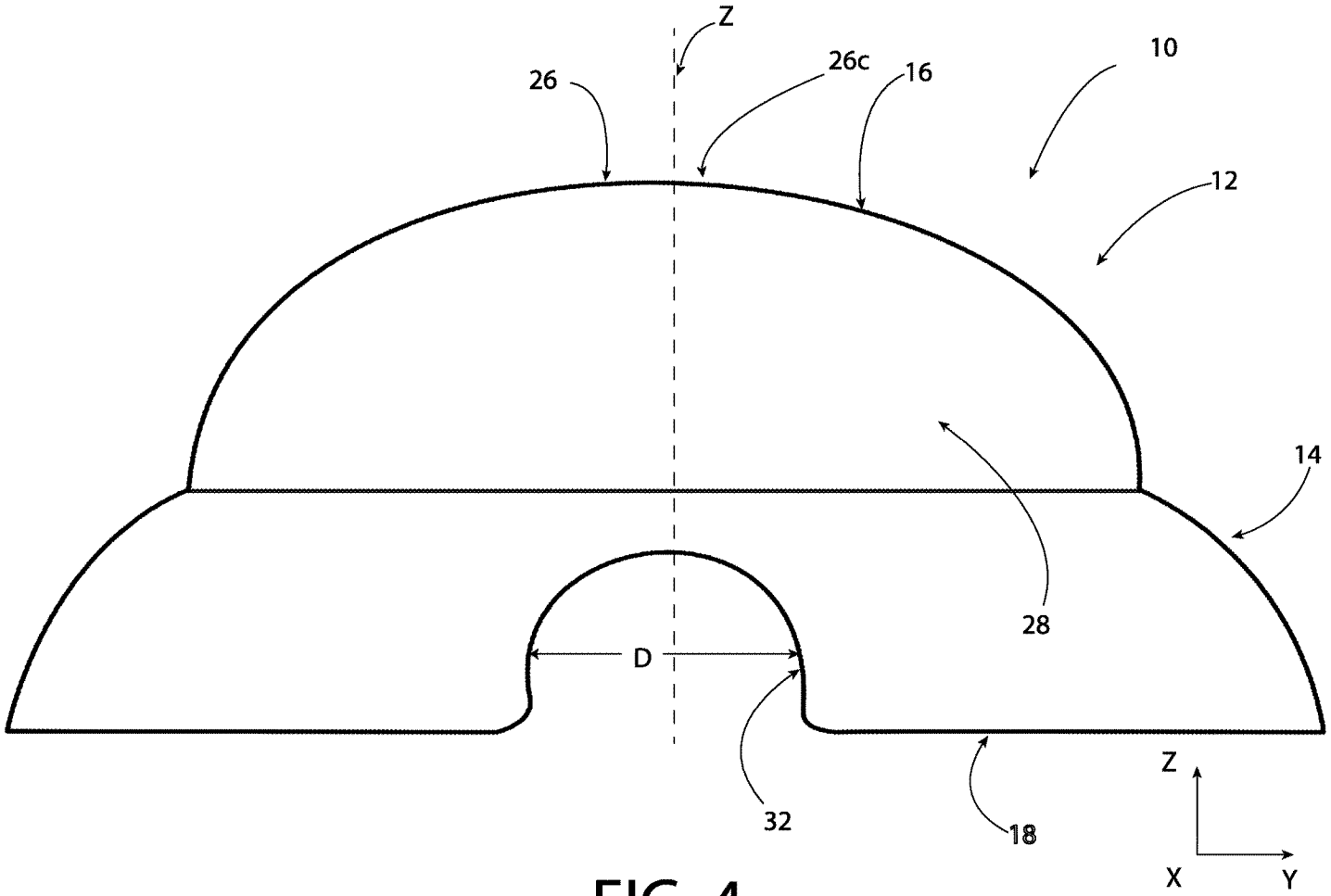
FIG. 4 is an end view of the portable head support of FIG. 1.
Figure 5:
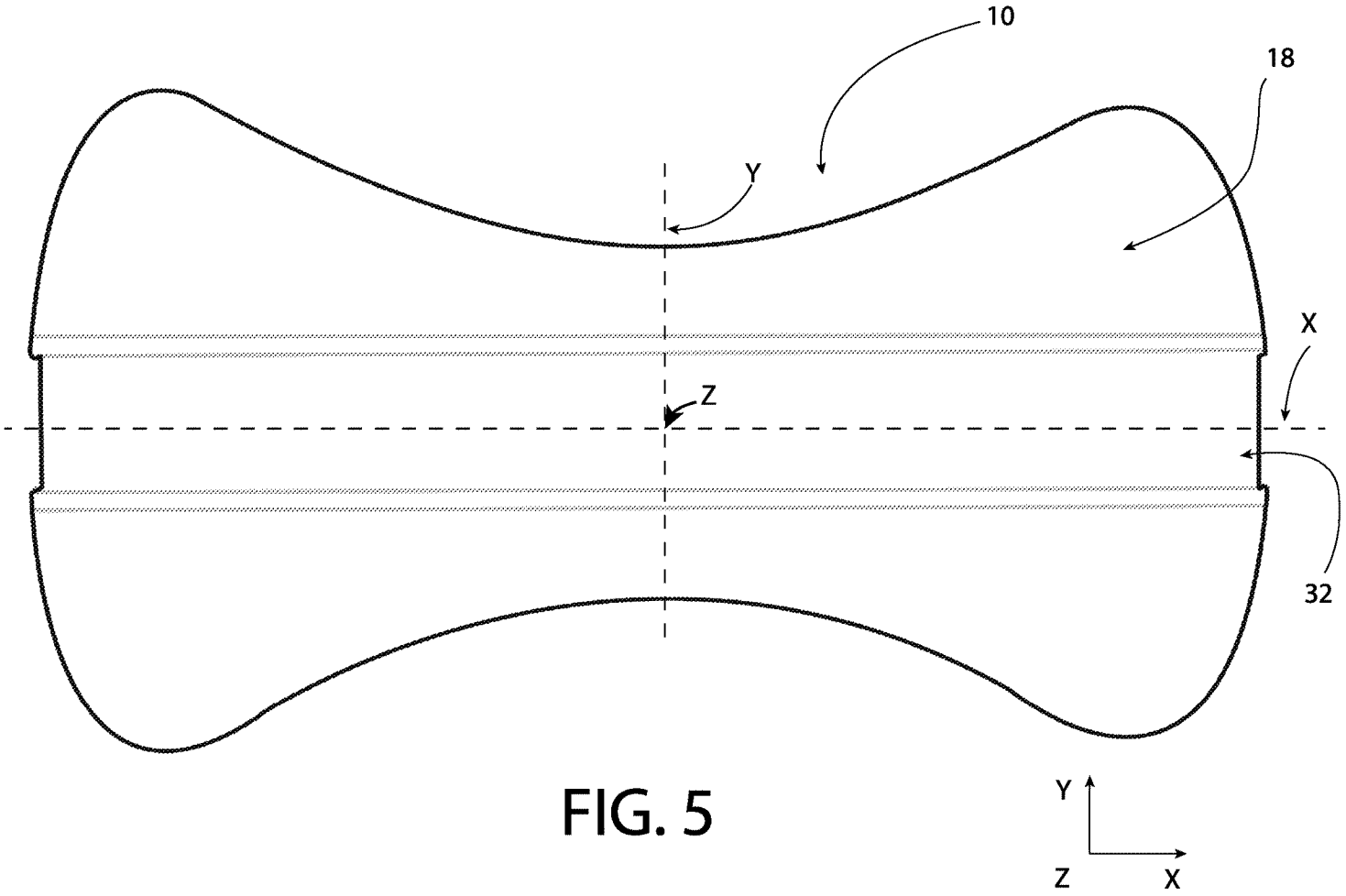
FIG. 5 is a bottom view of the portable head support of FIG. 1.

Referring now to FIGS. 1-5, a portable head support 10 is shown according to an embodiment of the invention. In general, the head support 10 includes an upper portion, shown generally at 12, and a lower portion, shown generally at 14. Both the upper portion 12 and the lower portion 14 are generally dog-bone in shape, as shown in FIG. 2. Thus, the head support 10 is generally dog-bone in shape, as shown in FIGS. 2 and 5. As used herein, a dog-bone shape is defined as a 2- or 3-dimensional compound shape, evocative of a dog biscuit or dog-bone toy with a central shaft and two lobes (analogous to femoral condyles) at each end.

As shown in FIG. 2, the lower portion 14 has a profile that extends outward from the upper portion 12. In addition, the head support 10 is substantially symmetric about two axes, the longitudinal axis, X, and the lateral or transverse axis, Y, as shown in FIGS. 2 and 3. The symmetry of the head support 10 allows the head support 10 to be bi-directionally mounted onto an object. In other words, the symmetry of the head support 10 of the invention can be mounted on an object, if desired, in two different ways by rotating the head support 10 about 180° about the vertical axis, Z.

The upper portion 12 of the head support 10 has a top surface, shown generally at 16, and the lower portion 14 of the head support 10 has a bottom surface, shown generally at 18. In one embodiment, the bottom surface 18 is substantially planar to allow the head support 10 to properly lay on a flat surface, if desired. However, it will be appreciated that the invention is not limited by the bottom surface 18 being substantially planar, and that the invention can be practiced with a bottom surface 18 being non-planar, if desired.

As shown in FIGS. 1-3, the top surface 16 has a distinctive topography that includes a first lobe portion 22 at one end 24, a second lobe portion 26 at an opposite end 28, and an intermediate or shaft portion 30 separating the first and second lobe portions 22, 26. In addition, each lobe portion 22, 26 has an inner portion 22*a*, 26*a* proximate to the intermediate or shaft portion 30, an outer portion 22*b*, 26*b* distal to the intermediate or shaft portion 30 (i.e. proximate the ends 24, 28), and an apex 22*c*, 26*c* therebetween. As shown in FIG. 3, each lobe portion 22, 26 has a generally convex profile, and the intermediate or shaft portion 30 has a slightly concave profile when viewed from the front of the portable head support 10. The purpose of the distinctive topography of the lobe portions 22, 26 and the intermediate shaft portion 30 allows a user 40 to comfortably rest their forehead on the portable head support 10, while in a sitting position or in a prone position.

In the illustrated embodiment, the intermediate or shaft portion 30 has a height, $H_I$, and a length, $L_I$, with respect to the bottom surface 18, and each lobe portion 22, 26 has a height, $H_L$, and a length, $L_L$, with respect to the bottom surface 18, as shown in FIG. 3. The height, $H_I$, and the length, $L_I$, of the intermediate or shaft portion 30 are less than the height, $H_L$, and the length, $L_L$, of the first and second lobe portions 22, 26. Thus, the intermediate or shaft portion 30 is lower in elevation with respect to the lower portion 14 than the first and second lobe portions 22, 26 when viewed from the front as shown in FIG. 3. In other words, the first and second lobe portions 22, 26 are higher in elevation than the intermediate or shaft portion 30 by the difference of the heights, $H_I$, $H_L$. In one embodiment, the difference, in the heights, $H_I$, $H_L$, is about 0.50 inches. The difference, in the heights allow a user to comfortably breathe while placing their forehead on the head support 10. However, it will be appreciated that the invention is not limited by the magnitude of the difference, in the heights, $H_I$, $H_L$, and that the invention can be practiced with any difference, so long as the user can comfortably breathe while placing their forehead on the head support 10.

It should be noted that the height, $H_I$, can be any desirable height with respect to the bottom surface 18. In one embodiment, the height, $H_I$, of the intermediate portion is approximately equal to the height of the lower portion 14 with respect to the bottom surface 18, as shown in phantom in FIG. 3. In this embodiment, the height of the lower portion 14 with respect to the bottom surface 18 is about 1.0 inches. In this embodiment, much less material is used to form the upper portion 12, and therefore is more economical to manufacture.

It will be appreciated that the dimensions of the portable head support 10 according to the invention will depend to some extent upon the end user, i.e., whether the user is an adult or child. In either case, the portable head support 10 has dimensions that allow the user 40 to easily transport the portable head support 10 in a handbag, and the like.

In the case where the head support 10 is to be used by an adult, the portable head support 10 has a total width, $W_T$, of about 4.5 inches, as shown in FIG. 2. The intermediate or shaft portion 30 has a width, $W_I$, of about 1.75 inches, and each lobe portion 22, 26 has a width, $W_L$, of about 2.45 inches. The portable head support 10 has a total length, $L_T$, of about 8.0 inches, as shown in FIG. 3. The intermediate or shaft portion 30 has a height, $H_I$, of about 1.75 inches from the bottom surface 18, and a length $L_I$, of about 1.8 inches. Each lobe portion 22, 26 has a height, $H_L$, of about 2.25 inches from the bottom surface 18, and a length, $L_L$, of about 2.58 inches. Thus, the height of the bottom portion 14 is about 1.0 inches from the bottom surface 18. Thus, the dimensions of the portable head support 10 is such that the head support 10 can be easily transported by the user 40 in a handbag (not shown), and the like. It will be appreciated that the dimensions of the portable head support 10 would be smaller in the case in which the portable head support 10 is to be used by a child.

As shown in FIG. 3, the inner portions 22*a*, 26*a* of each lobe portion 22, 26 and the intermediate or shaft portion 30 have a generally U-shaped, convex profile when viewed from the front of the head support 10. This generally U-shaped, concave profile generally conforms to the shape or curvature of the forehead of the user, thereby allowing the user to comfortably rest their forehead on the head support 10.

As shown in FIGS. 1 and 4, the lobe portions 22, 26 and the intermediate or shaft portion 30 has a generally U-shaped, convex profile when viewed from the end of the head support 10. This generally U-shaped, convex profile minimizes the surface area of the top surface 16 contacting the forehead of the user when resting their forehead on the head support 10, thereby increasing the comfort of using the head support 10 when in use. In addition, the U-shaped, convex profile minimizes the amount of material, thereby decreasing the cost of manufacturing the head support 10.

In one embodiment, the head support 10 is formed by molding a suitable material, thereby forming a head support 10 having a unitary construction. The head support 10 can be provided of various materials, for example, various plastic foams, whether of open or closed cells. The head support 10 can be of a foam rubber, natural or synthetic, as desired. Suitable foams include rubber latex, polyurethane, polyethylene and vinyl foams. Whatever the material used, it should provide a soft, nonabrasive cushion for the user's forehead. It should, of course, be of a flexible foam but not be so compressed when a person's head is being supported.

It will be appreciated that consideration needs to be given to the density of the foam. It will be readily appreciated that a lesser dense polyurethane foam will be compressed to a greater extent than a denser foam by the same person. Thus, the extent of compression of any particular foam needs to be taken into consideration.

In one embodiment, the head support 10 is made of a flexible polyurethane foam material sold under the tradename FLEX FOAM-IT!®, which is commercially available from Smooth-On, Inc. of Macungle, Pa. (See https://www.smooth-on.com/products/flexfoam-it-14/. In one embodiment, the flexible polyurethane foam has a density of about 14 lbs/ft$^3$. However, it will be appreciated that the invention is not limited by the type of material and the density of the material used for the head support 10, and that the invention can be practiced using any desirable material, so long as the material exhibits the desired flexibility. For example, the head support 10 can be made of organic, earth-friendly materials, and the like.

One aspect of the invention is that the bottom surface 18 includes a groove or channel 32 formed therein. In general, the groove 32 allows the head support 10 to be removably mounted to an object. In the illustrated embodiment, the groove 32 extends entirely across the bottom surface 18 of the portable head support 10, as shown in FIG. 5. In addition, the groove 32 is centrally disposed substantially along the longitudinal axis, X, of the head support 10. Thus, the groove 32 is symmetric about the longitudinal axis, X.

The groove 32 has a cross-sectional shape that is complimentary to a cross-sectional shape of the object to allows the head support 10 to be removably mounted to the object. In the illustrated embodiment, for example, the groove 32 has a substantially circular cross-sectional shape with a diameter, D, as shown in FIG. 4. In one embodiment, the diameter, D, is of sufficient dimension to allow the portable head support 10 to be removably mounted onto a bar or strut of a lounge chair, a steering wheel of a motor vehicle, and the like. In one embodiment, the diameter, D, is about one-inch. However, it will be appreciated that the invention is not limited by the magnitude of the diameter, D, and that the invention can be practiced with a groove 32 having any desirable diameter, D, that will allow the head support 10 to be removably mounted onto the object. In addition, the invention is not limited by the cross-sectional shape of the groove 32, and that the invention can be practiced with the groove 32 having any desirable cross-sectional shape. For example, the groove 32 can be triangular, rectangular, square, and the like, in cross-sectional shape, so long as the cross-sectional shape of the groove 32 is complimentary to the cross-sectional shape of the object to allow the head support 10 to be removably mounted thereon.

Figure 6:
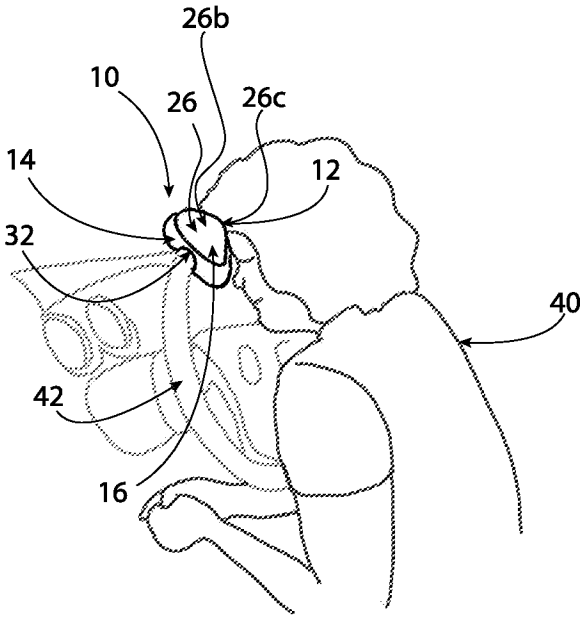
FIG. 6 an example of the portable head support during use by a person in a sitting position.

FIG. 6 shows an example of the portable head support 10 in use by a person 40 in a sitting position. In this example, the portable head support 10 is removably mounted to a steering wheel 42 of the motor vehicle. It is noted that the groove 32 is substantially straight when the portable head support 10 is in a resting position (i.e. not subject to bending stresses), as shown in FIG. 5. However, because the portable head support 10 is made of suitable flexible material, the head support 10 can be shaped in such a way that the arcuate-shaped steering wheel 42 can be disposed within the groove 32, thereby allowing the portable head support 10 to be mounted thereon.

Figure 7:
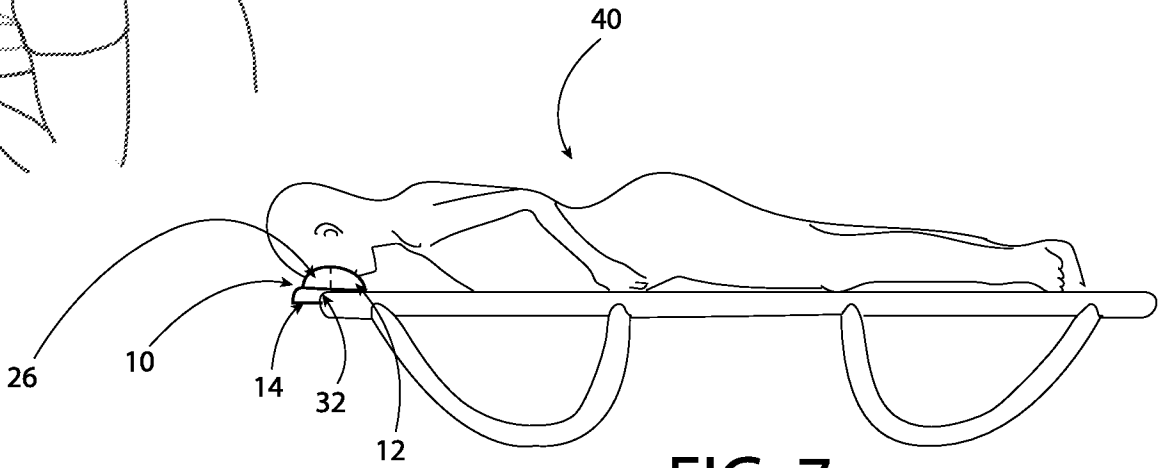
FIG. 7 shows another example of the portable head support during use by a person in a prone position.

FIG. 7 shows another example of the portable head support 10 in use by a person 40 in a prone position. In this example, the portable head support 10 is removably mounted to a bar or strut 42 of the lounge chair, so that the person 40 can rest their forehead on the portable head support 10 while in a prone position. Thus, the portable head support 10 of the invention allows a person to rest their forehead in either a sitting position or in a prone position. In addition, a person can removably mount the portable head support 10 on either a linear-shaped object or an arcuate-shaped object.

The patents and publications referred to herein are hereby incorporated by reference.

Having described presently preferred embodiments the invention may be otherwise embodied within the scope of the appended claims.

What is claimed is:

1. A portable head support having a dog-bone shape, comprising:

an upper portion having a top surface; and a lower portion having a bottom surface, wherein the top surface includes a first lobe portion at one end along a longitudinal axis, X, a second lobe portion at an opposite end along the longitudinal axis, X, and an intermediate or shaft portion separating the first and second lobe portions, wherein the intermediate or shaft portion has a length, $L_I$, and a width, $W_I$, with respect to the bottom surface, wherein the first and second lobe portions each have a length, $L_L$, and a width, $W_L$, with respect to the bottom surface, wherein the length, $L_I$, of the intermediate or shaft portion is less than the length, $L_L$, of the first and second lobe portions; and wherein the width, $W_I$, of the intermediate or shaft portion is less than the width, $W_L$, of the first and second lobe portions, wherein the intermediate or shaft portion has a height, $H_I$, with respect to the bottom surface, and wherein the first and second lobe portions each have a height, $H_L$, with respect to the bottom surface, wherein the height, $H_I$, of the intermediate or shaft portion is less than the height, $H_L$, of the first and second lobe portions; and wherein the bottom surface includes a groove extending the longitudinal axis, X, for allowing the portable head support to be removably mounted onto an object.

2. The portable head support according to claim 1, wherein each lobe portion has an inner portion proximate the intermediate or shaft portion, and outer portion distal the intermediate or shaft portion and an apex therebetween.

3. The portable head support according to claim 1, wherein each lobe portion has a generally convex profile, and wherein the intermediate or shaft portion has a concave profile when viewed from a front of the portable head support, thereby allowing a user to comfortably rest their forehead on the portable head support.

4. The portable head support according to claim 1, wherein the first and second lobe portions and the intermediate or shaft portion has a generally U-shaped, convex profile when viewed from an end of the portable head support, thereby minimizing a surface area of the top surface that contacts a forehead of the user when in use.

5. The portable head support according to claim 1, wherein a difference between the height, $H_I$, of the intermediate or shaft portion and the height, $H_L$, of the first and second lobe portions is about 0.5 inches.

6. The portable head support according to claim 1, wherein the groove is substantially circular in cross-sectional shape with a diameter, D.

7. The portable head support according to claim 1, wherein the groove extends entirely across the bottom surface of the portable head support.

8. The portable head support according to claim 1, wherein the head support is substantially symmetric about the longitudinal axis, X, and a lateral or transverse axis, Y, thereby allowing the portable head support to be bi-directionally mounted onto an object by rotating the portable head support about a vertical axis, Z.

9. The portable head support according to claim 1, wherein the lower portion has a profile that extends outward from the upper portion.

10. The portable head support according to claim 1, wherein the bottom surface is substantially planar except for the groove.

11. The portable head support according to claim 1, wherein the portable head support is of unitary construction and made of a flexible polyurethane foam material having a density of about 14 lbs/ft$^3$.

* * * * *